US005125426A

United States Patent [19]

Wu et al.

[11] Patent Number: 5,125,426

[45] Date of Patent: Jun. 30, 1992

[54] AUTOMATICALLY CLOSING UMBRELLA

[76] Inventors: Tsun-Zong Wu; Chung K. Lin, both of No. 16, Chen-Tai Road, Sec. 3, Wu-Ku Hsiang, Taipei Hsien (24801), Taiwan

[21] Appl. No.: 741,550

[22] Filed: Aug. 7, 1991

[51] Int. Cl.[5] ..... A45B 25/14

[52] U.S. Cl. ..... 135/23; 135/24; 135/44

[58] Field of Search ..... 135/24, 23, 22, 44

[56] References Cited

U.S. PATENT DOCUMENTS 3,003,508 10/1961 Bremshey ..... 135/24
4,149,553 4/1979 Lee ..... 135/24
5,058,613 10/1991 Su ..... 135/24
5,060,684 10/1991 Wu ..... 135/24

FOREIGN PATENT DOCUMENTS 9642 9/1941 Fed. Rep. of Germany .
801216 12/1950 Fed. Rep. of Germany ..... 135/24
10035 of 1844 United Kingdom .

*Primary Examiner*—Henry E. Raduazo

[57] ABSTRACT

An umbrella includes a shaft restoring spring provided in a central shaft of the umbrella which will store its elastic force when opening the umbrella and extendig the shaft so that upon a depression of a closing controller formed on a grip of the umbrella, the shaft restoring spring will restore to retract the shaft in order to quickly close the umbrella as assisted by a rib restoring spring which restores to close the umbrella ribs.

1 Claim, 4 Drawing Sheets

AUTOMATICALLY CLOSING UMBRELLA

BACKGROUND OF THE INVENTION

U.S. Pat. No. 4,941,494 also granted to the same inventor of the application and entitled "Lightly-operating Automatic Umbrella for Preventing False Operation" disclosed on automatic umbrella which can be opened and closed automatically. However, when such an umbrella is opened, the extending spring (3) still urges the upper shaft (14) and the ribs (2) upwardly outwardly to open the umbrella to overcome the spring force acted by the retraction spring (4). When closing the umbrella, the tension of the extending spring (3) should be released first by depressing the seesaw button (51) and then the retraction restoring spring (4) will restore the ribs (2) downwardly inwardly to close the umbrella. The retraction restoring spring (4) will effect its automatic closing function only after the releasing of the spring force of the extending spring (3) held in the central shaft (1), thereby causing a time delay for an umbrella-closing operation.

It is therefore expected to disclose an umbrella which can be closed automatically and quickly.

SUMMARY OF THE INVENTION

The object of the present invention is to provide an automatically closing umbrella which is especially helpful for using the umbrella when taking a bus or a taxi under rainy day so that the umbrella user may immediately and automatically close or fold his or her umbrella when getting on a bus or taxi to shorten the umbrella-closing time to prevent an embarrassing waiting by a bus or taxi driver.

Another object of the present invention is to provide an umbrella having a shaft restoring spring provided in a central shaft of the umbrella which will store its elastic force when opening the umbrella and extending the shaft so that upon a depression of a closing controller formed on a grip of the umbrella, the shaft restoring spring will restore to retract the shaft in order to quickly close the umbrella as assisted by a rib restoring spring which restores to close the umbrella ribs.

DETAILED DESCRIPTION

Figure 1:
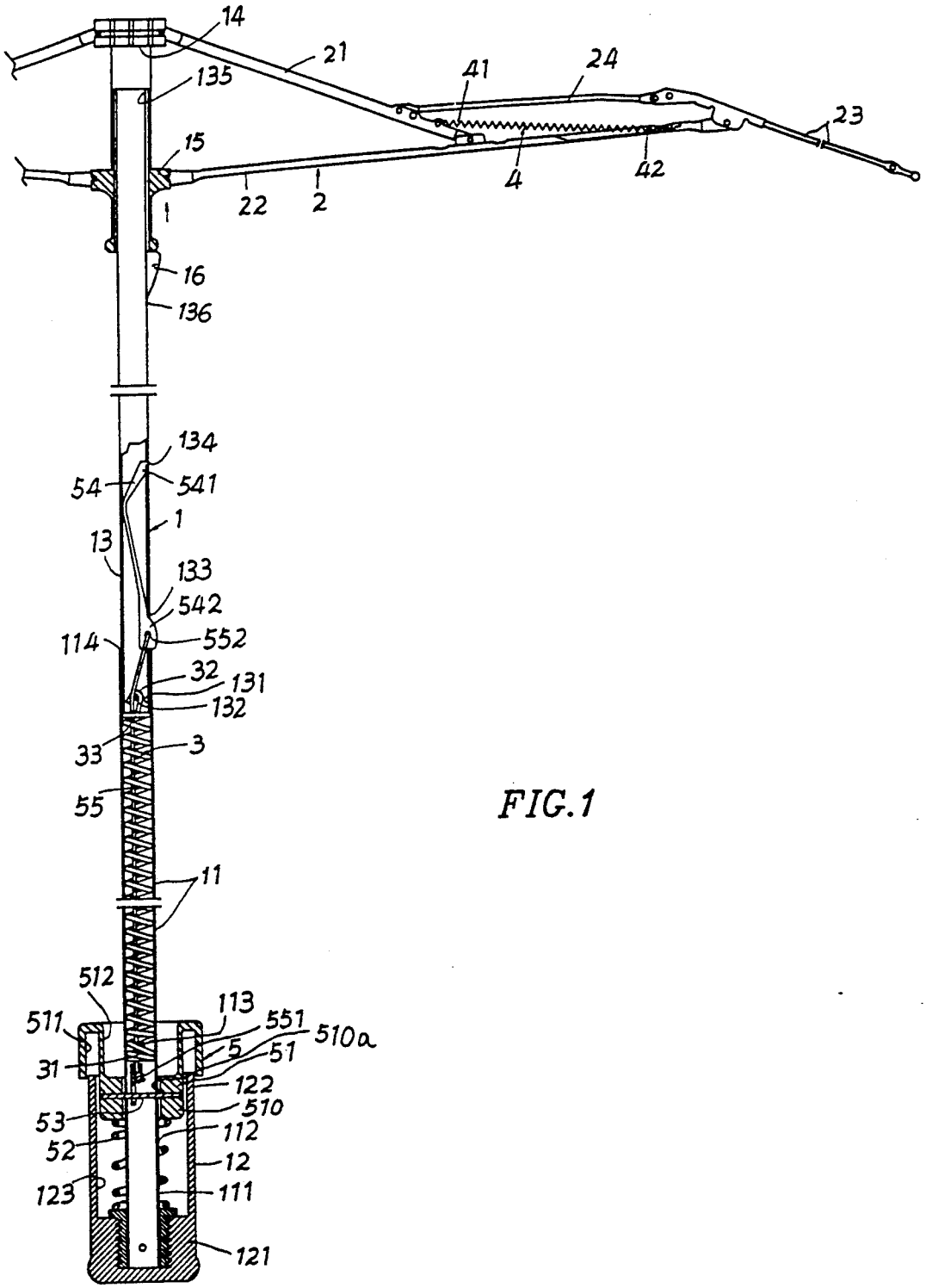
FIG. 1 is an illustration of the present invention when opened.
Figure 2:
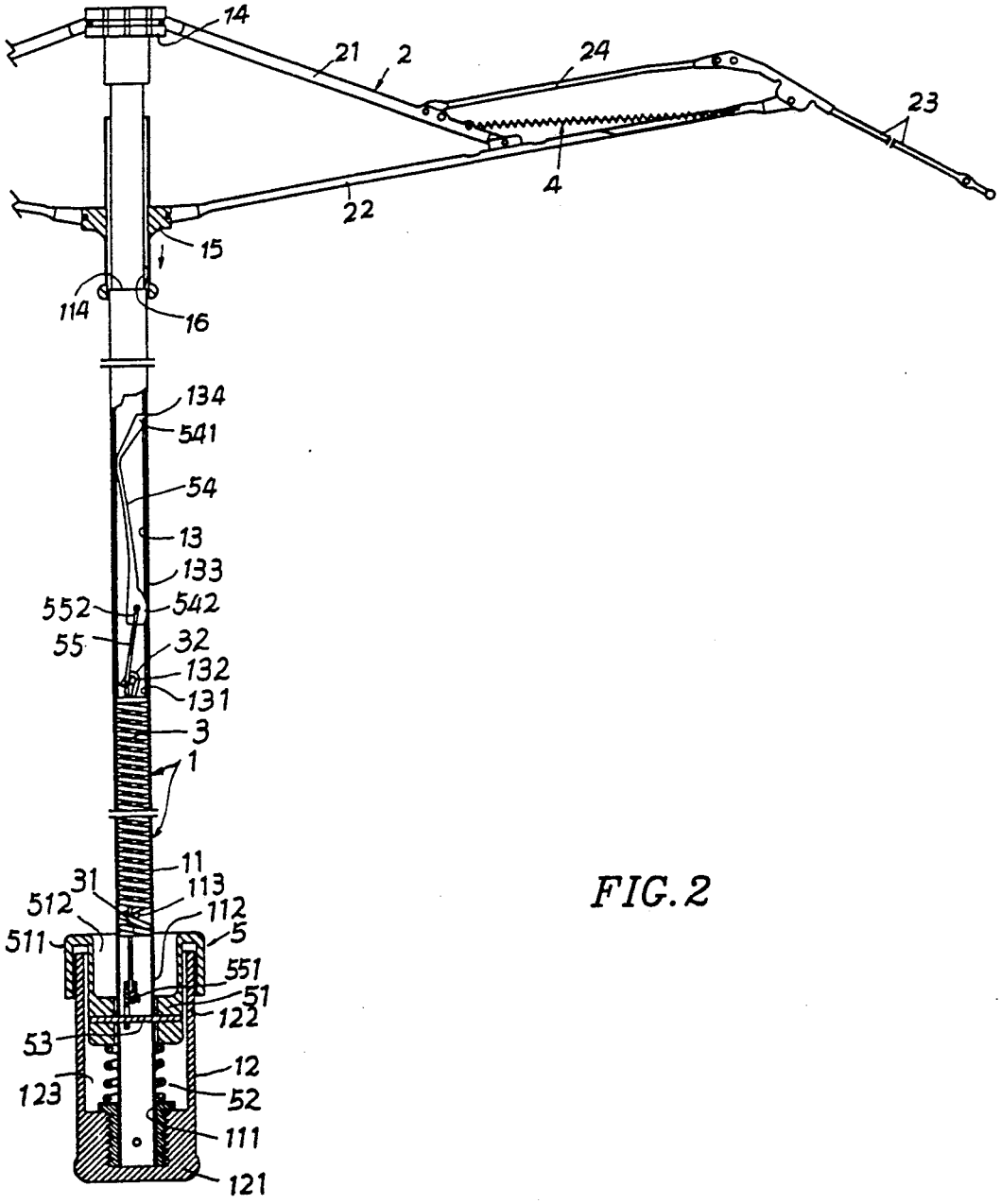
FIG. 2 shows an umbrella performing a closing operation in accordance with the present invention.

As shown in FIGS. 1–4, the present invention comprises: a central shaft means 1, a rib assembly 2, a shaft restoring spring 3, a rib restoring spring 4, and a closing controller 5.

The central shaft means 1 includes: a lower shaft 11 having a grip 12 secured on a lowest portion 111 of the lower shaft 11, an upper shaft 13 telescopically held in and operatively extended above the lower shaft 11, an upper notch 14 formed on a top portion 135 of the upper shaft 13, a lower runner 15 slidably held on the central shaft means 1 and a spring catch 16 resiliently formed on an upper portion 136 of the upper shaft 13.

The lower shaft 11 is formed with a pin slot 112 in a lower portion of the lower shaft 11 adjacent to the lowest portion 111 of the shaft 11 and a lower pin 113 transversely fixed in the lower portion of the shaft 11 for securing a lower spring end 31 of the shaft restoring spring 3 held in the central shaft means 1.

The grip 12 includes a bottom portion 121 secured with the lowest portion 111 of the lower shaft 11, and a hollow sleeve portion 122 generally cylindrical shaped protruding upwardly from the bottom portion 121 of the grip 12 defining a grip hollow portion 123 within the hollow sleeve portion 122.

The upper shaft 13 includes a lowest end portion 131 contacting an upper spring ring portion 33 of the shaft restoring spring 3, an upper pin 132 for securing an upper spring end 32 of the shaft restoring spring 3 on the upper pin 132 transversely fixed on a lower portion of the upper shaft 13, a cam slot 133 formed in another lower portion of the upper shaft 13 above the upper pin 132, and a retaining hole 134 formed in the upper shaft 13 above the cam slot 133.

The rib assembly 2 is a conventional means of an umbrella and not limited in this invention and may include a top rib 21 having an inner portion of the top rib pivotally secured to the upper notch 14, a stretcher rib 22 having an inner portion of the stretcher rib 22 pivotally secured to the lower runner 15 and a middle portion of the rib 22 pivotally secured with an outermost end portion of the top rib 21, an outer rib 23 having an innermost end of the rib 23 pivotally connected with a reinforcing rib 24 which is pivotally secured to an outer portion of the top rib 21 and having an inner portion of the rib 23 pivotally connected with an outer portion of the stretcher rib 22. The rib restoring spring 4 is resiliently secured on the rib assembly 2 and may have an inner spring end 41 secured to the outer portion of the top rib 21 and an outer spring end 42 secured to the outer portion of the stretcher rib 22. However, the positioning of the rib restoring spring 4 on the rib assembly 2 is not limited in this invention.

The closing controller 5 includes: a sliding actuator 51 resiliently held in the grip 12 by an actuator tensioning spring 52 retained between the bottom portion 121 of the grip 12 and the sliding actuator 51, a pulling pin 53 transversely fixed in the sliding actuator 51 and slidably held in the pin slot 112 formed in the lower shaft 11, a spring latch 54 formed as an arcuate spring plate resiliently mounted in the upper shaft 13, and an actuating wire 55 secured between the pulling pin 53 and the spring latch 54.

The sliding actuator 51 includes: an annular sliding block 510 having a central shaft hole **510*a* formed in the block 510 for slidably reciprocating the block 510 on the lower shaft 11 within the grip hollow portion 123 of the grip 12, a tip cap portion 511 formed with a double-cylindrical-wall portion slidably engageable with the hollow sleeve portion 122 of the grip 12, and an actuator hollow portion 512 recessed in the tip cap portion 511 for operatively receiving a plurality of rib tips 25 of the rib assembly 2 in the actuator hollow portion 512**.

The spring latch 54 generally formed as arcuate spring plate has an upper end portion 541 of the latch 54 fixed in the retaining hole 134 in the upper shaft 13, and a lower cam portion 542 protruding outwardly to be engageable with the cam slot 133 formed in the lower portion of the upper shaft 13 and lockably seating on an upper edge portion 114 of the lower shaft 11 as shown in FIG. 1 when opening the umbrella. The actuating wire 55 has its upper wire end 552 secured to the cam portion of the spring latch 54 and has a lower wire end 551 secured to the pulling pin 53 fixed on the actuator 51.

Figure 3:
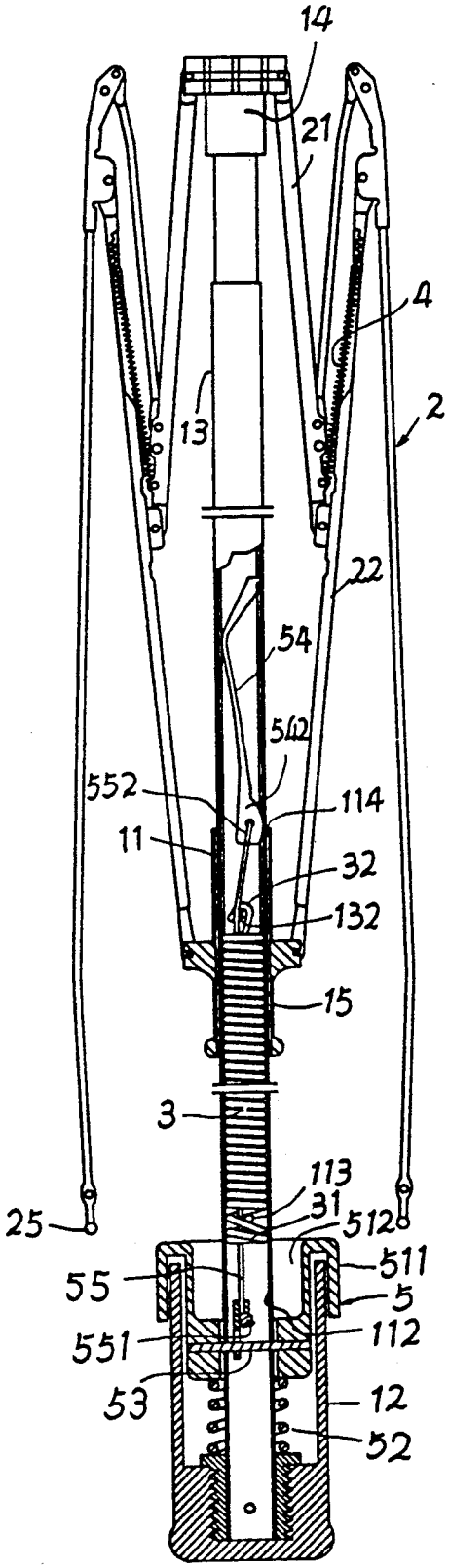
FIG. 3 shows a folded umbrella of the present invention.
Figure 4:
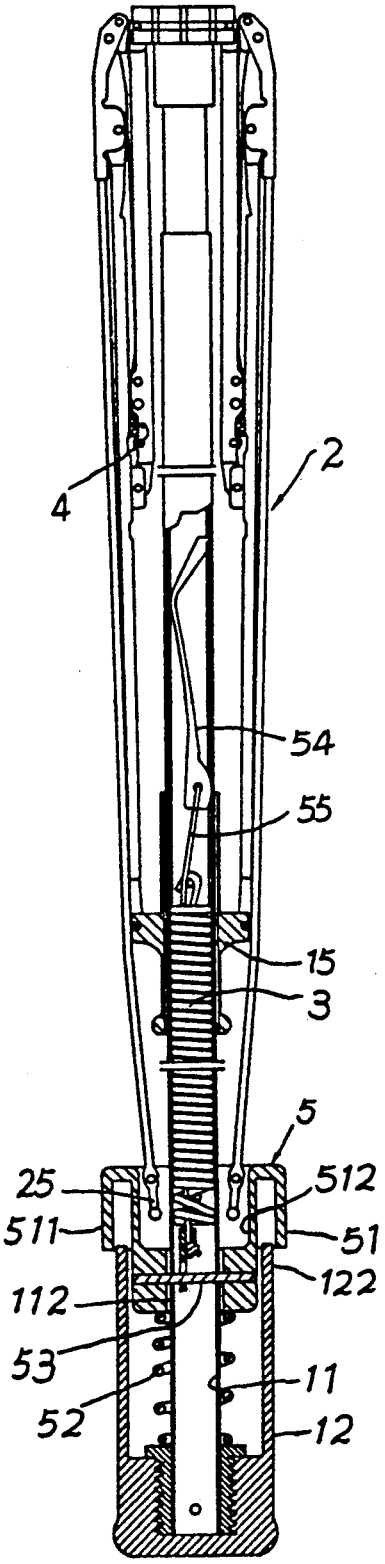
FIG. 4 shows the folded umbrella having rib tips shielded in a tip cap portion formed on the grip.

In using the present invention for opening an umbrella from a folded state as shown in FIG. 4, the tip cap portion 511 is depressed downwardly to release the tips 25 of the rib assembly 2 and the runner 15 is raised from FIG. 3 to FIG. 1 until being stopped by the spring catch 16 resiliently formed on the upper shaft 13. During the uprising movement of the runner 15 along the shaft means 1, the upper shaft 13 is extended upwardly from the lower shaft 11 to extend the shaft restoring spring 3 secured between the two shafts 13, 11 to store its spring or restoring force and also to tension the rib restoring spring 4 to store its restoring elastic energy. After the spring catch 16 limits the runner 15 as shown in FIG. 1 and the cam portion 542 of the spring latch 54 (normally resiliently protruding outwardly) is engaged with the cam slot 133, the extended upper shaft 13 will be stopped or locked above the lower shaft 11 even under tension by the spring 3 so as to ensure a stable opening of the umbrella.

Once the opened umbrella is expected to be closed, the sliding actuator 51 of the closing controller 5 is depressed downwardly to allow the pulling pin 53 to pull the cam portion 542 of the spring latch 54 to disengage from the cam slot 133, and the spring 3 under tension will restore to retract the upper shaft 13 to the lower shaft 11 and the rib restoring spring 4 also restores the ribs 2 inwardly downwardly so as to fold or close the umbrella quickly, immediately.

The closing sequence may be shown from FIG. 1–FIG. 4, in which when retracting the upper shaft 13 downwardly into the lower shaft 11, the spring catch 16 having a lower sloping portion tapered downwardly will be retracted inwardly by the upper edge portion 114 of the lower shaft 11, thereby allowing a downward sliding of runner 15 for closing the ribs 2.

Since both the restoring springs 3, 4 are restored in a same direction to retract the shafts 13, 11 and to fold the ribs 2, the folding operation of this invention is superior to the inventor's earlier filed and granted patent as aforementioned.

After folding the umbrella as shown in FIG. 3, the tips 25 may be contracted into the hollow portion 512 within the tip cap 511 as shown in FIG. 4

Even this invention can not be opened automatically, it is especially designed for the circumstances which require an immediate closing or folding of the umbrella such as for a bus or taxi passenger. So, this invention still has its commercial value.

We claim:

1. An automatically closing umbrella comprising:

a central shaft means including a lower shaft secured with a grip thereon and an upper shaft telescopically mounted on the lower shaft;

a rib assembly having at least a top rib pivotally secured to an upper notch formed on an uppermost portion of the upper shaft and at least a stretcher rib pivotally secured with each said top rib and secured to a lower runner which is operatively stopped on a spring catch resiliently formed in said upper shaft when opening the umbrella;

a shaft restoring spring resiliently held between said lower and said upper shafts of said central shaft means for normally retracting said upper shaft towards said lower shaft for retracting said central shaft means by a restoring elastic energy created when extending said shafts for opening the umbrella;

at least a rib restoring spring resiliently mounted on said rib assembly operatively urging said rib assembly inwardly downwardly for folding said rib assembly for closing an umbrella from an opened state thereof; and a closing controller formed on said grip and in said central shaft means operatively actuating said shaft restoring spring for releasing its restoring elastic energy for automatically retracting said upper shaft towards said lower shaft for closing said umbrella from an opened state of the umbrella; said lower shaft formed with a pin slot in a lower portion of the lower shaft adjacent to a lowest portion of the lower shaft and a lower pin transversely fixed in the lower portion of the lower shaft for securing a lower spring end of the shaft restoring spring held in the central shaft means; and said closing controller including: a sliding actuator resiliently held in the grip by an actuator tensioning spring retained between the bottom portion of the grip and the sliding actuator, a pulling pin transversely fixed in the sliding actuator and slidably held in the pin slot formed in the lower shaft, a spring latch formed as an arcuate spring plate resiliently mounted in the upper shaft, and an actuating wire secured between the pulling pin and the spring latch;

said sliding actuator including: an annular sliding block having a central shaft hole formed in the block for slidably reciprocating the block on the lower shaft within a grip hollow portion of the grip, a tip cap portion formed with a double-cylindrical-wall portion slidably engageable with a hollow sleeve portion of the grip, and an actuator hollow portion recessed in the tip cap portion for operatively receiving a plurality of rib tips of the rib assembly in the actuator hollow portion; and said spring latch having an upper end portion of the latch fixed in a retaining hole formed in the upper shaft, and a lower cam portion protruding outwardly to be engageable with a cam slot formed in a lower portion of the upper shaft and lockably seating on an upper edge portion of the lower shaft when opening the umbrella, said actuating wire having its upper wire end secured to the cam portion of the spring latch and having a lower wire end secured to the pulling pin fixed on the sliding actuator.

* * * * *